United States Patent [19]

Anderson

[11] Patent Number: 5,015,039

[45] Date of Patent: May 14, 1991

[54] HYDRAULICALLY ACTUATED MECHANICAL ROCK EXCAVATOR

[75] Inventor: Sterling J. Anderson, Maple Grove, Minn.

[73] Assignee: The United States of America as represented by the Department of the Interior, Washington, D.C.

[21] Appl. No.: 461,950

[22] Filed: Jan. 8, 1990

[51] Int. Cl.[5] ..... E21C 37/02

[52] U.S. Cl. ..... 299/22; 299/23

[58] Field of Search ..... 299/20, 22, 23; 175/230

[56] References Cited

U.S. PATENT DOCUMENTS

| | | | |
|---|---|---|---|
| 3,565,488 | 2/1971 | Walsh | 299/22 |
| 4,099,784 | 7/1978 | Cooper | 299/23 X |
| 4,152,028 | 5/1979 | Allen | 299/23 |

FOREIGN PATENT DOCUMENTS

| | | | |
|---|---|---|---|
| 1167328 | 7/1985 | U.S.S.R. | 299/22 |

*Primary Examiner*—Ramon S. Britts
*Assistant Examiner*—David J. Bagnell
*Attorney, Agent, or Firm*—E. Philip Koltos

[57] ABSTRACT

An apparatus (10) for placing a hard compact material such as rock surrounding a drill hole into axial tension for the purpose of breaking and excavating the material by virtue of a dual piston (23) and (25) arrangement disposed within a fluid cylinder (16) wherein the first piston (23) is attached to a thrust rod member (28) the second piston is attached to a wedge member (30) having an outwardly tapered conical end (34) and a feather member (40) surrounding the wedge (30) and thrust (28) members; wherein the feather segments (43) have a conical profile on both their internal and external peripheries.

3 Claims, 2 Drawing Sheets

FIG. 1.
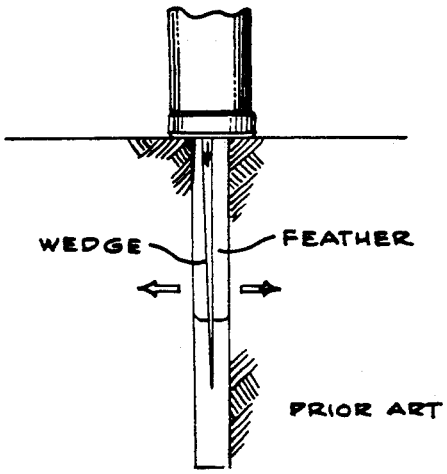
FIG. 2.
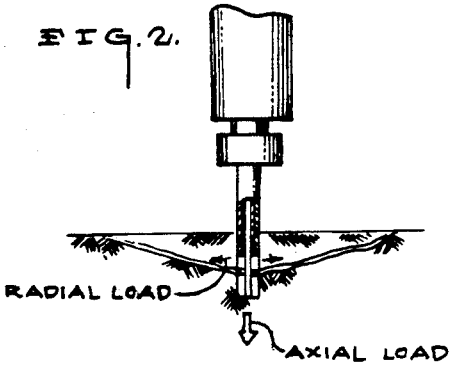
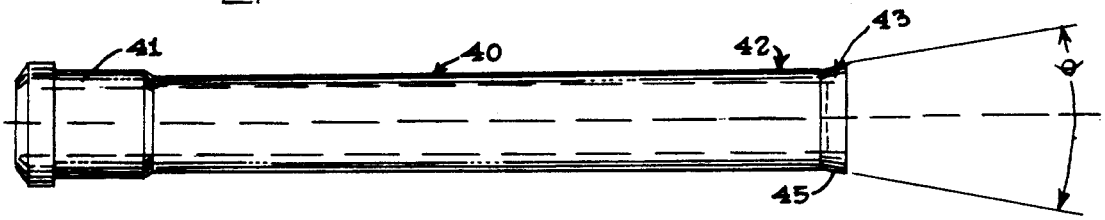
FIG. 3.
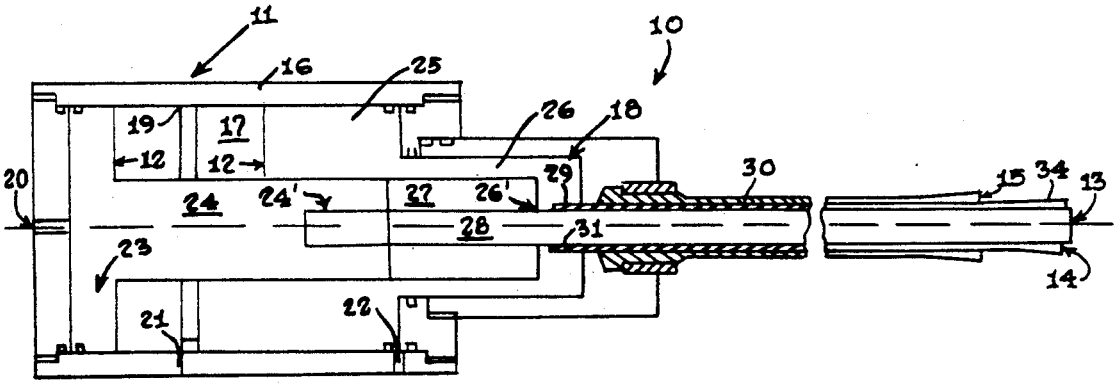
FIG. 4.

HYDRAULICALLY ACTUATED MECHANICAL ROCK EXCAVATOR

TECHNICAL FIELD

The present invention relates to hydraulically powered mechanical excavation tools in general, and more specifically to a radial and axial loading rock splitting apparatus.

BACKGROUND OF THE INVENTION

As be seen by reference to the following U.S. Pat. Nos. 4,072,353; 3,565,488; 4,311,343; 4,099,784; and 4,152,028 the prior art is replete with myriad and diverse hydraulically actuated rock splitting arrangements.

Mechanical rock excavation tools like this invention fall under the classification of rock splitters. Rock splitting tools normally apply loads to the rock from within a predrilled hole. The majority of these tools produce just radial loads and in operation they split rock along some roughly planar surface that contains the drill-hole axis.

Some rock splitters, including this invention, produce both radial and axial loads. Under the influence of this type of tool, the rock is split perpendicular to the drill-hole axis rather than along it. In use, this additional loading action makes it possible to excavate a plug of material from a mass.

In the design of this type of splitter, three coaxial mechanical rock breaking elements that are affixed to a special hydraulic cylinder that contains two independent double-acting pistons are placed within a predrilled hole. Of the three coaxial elements, two called the wedge and feather combine to produce the radial load. The wedge element is affixed to one of the hydraulic cylinders' two pistons and the feather is affixed to the cylinder body itself. The action of the wedge causes it to be withdrawn into the feather element.

This action produces two problems. The first is a result of the unique design of this hydraulic cylinder. The two pistons it contains operate independently traveling toward one another within the cylinder. Because sufficient room for movement is provided for each piston, it is possible for the piston, to which the wedge is affixed, to travel too far. This over travel causes the end of the wedge to be withdrawn past the end of the feather. This action produces brittle, or ductile, failure of the feather.

The second problem is in the design of the wedge and feather elements contacting surfaces. The wedge element is designed with an end that has an increasing conical profile. Correspondingly, the feather has an end that has a matching conical profile on its interior surface where the two elements contact before the wedge is withdrawn. The feather, being a split piece, is free to expand radially, contacting and loading the drill-hole wall.

This radial loading action is accomplished by withdrawing the conical-shaped end of the wedge into the feather's segments. A problem arises because the contacting conical surfaces of these two elements become mismatched as the wedge is being withdrawn. The relative movement of the wedge to the feather causes each feather segment to contact an ever increasing conic diameter on the wedge. This mismatching results in the formation of a gap between these pieces. Because the feather's segments are in effect being squeezed between the drill-hole wall and the wedge, the gap allows bending to occur in the segmented sections of the feather. This bending produces great stress in these segments resulting in their failure.

The feather has an additional design problem stemming from the exterior cylindrical geometry of its end. This design promotes a uniform stress distribution across its contact area with the drill-hole wall. This nonstress focusing design allows the disc-shaped fracture that develops in the rock to initiate anywhere along the feather's cylindrical exterior profile, limiting the operator's control over the initiation point. This cylindrical feather design also makes poor use of the load it transfers. The uniform distribution it produces creates rock stresses that are minimized rather than optimized resulting in a tool that is less effective than it could be.

SUMMARY OF THE INVENTION

The present invention comprises in general: a hydraulically-powered mechanical excavation tool. This tool uses a special hydraulic cylinder that contains two pistons, each capable of independent movement to power three mechanical rock breaking elements. Two of the mechanical elements are affixed to separate pistons within the hydraulic cylinder and the third element is affixed to the cylinder body itself. These elements are placed within a predrilled hole in rock where they are operated, providing independently controllable radial and axial loads.

The mechanical rock breaking elements are actuated by supplying fluid to the hydraulic cylinder through a pair of ports. In operation, a supply of fluid through one of the ports causes a first piston to move rearward within the cylinder toward a piston stop element. Because the wedge element is affixed to the first piston, it is withdrawn into the feathers. This action causes the feather element, which is split at it's working end, to expand radially forcing the feather segments into contact with the drill-hole wall and securely anchoring the tool within the hole under radial load.

Fluid is then supplied through the second port causing a second piston to move forward within the cylinder toward the piston stop element. Because the thrust rod element is affixed to the second piston, it is extended relative to the tool that is anchored in the drill hole. This extension brings the thrust rod into contact with the end of the drill hole, producing an axial load.

Because the tool is securely anchored within the drill hole, it cannot be forced from the rock mass under this action. Instead, the rock fractures with the tool tearing a plug of material from the mass, and the excavated rock plug may be removed as a whole or in sections.

The size of this rock plug is dependent on the depth that the working end of the feather element was placed in the drill hole. Up to this point, the third port of this tool has acted as a common return passage in the hydraulic circuit, and that port is now pressurized to force the two double-acting pistons back to their rest positions.

Specific structural and functional details of this invention that make it unique are: the conic exterior surface of the working end of the feather element; the unique machining of the interior surface of the working end of the feather element; and the piston stop travel feature in the hydraulic cylinder.

BRIEF DESCRIPTION OF THE DRAWINGS

These and other objects advantages and novel features of the invention will become apparent from the detailed description of the best mode for carrying out the preferred embodiment of the invention which follows; particularly when considered in conjunction with the accompanying drawings, wherein:

FIG. 1 is an enlarged detail view of the broad prior art method of radially loading a bore hole;

FIG. 2 is a view of the axial and radial loading produced by the present invention to remove rock plugs;

FIG. 3 is an enlarged side view of the feather element of this invention;

FIG. 4 is a cross-sectional view of the tool;

BEST MODE FOR CARRYING OUT THE INVENTION

Figure 5:
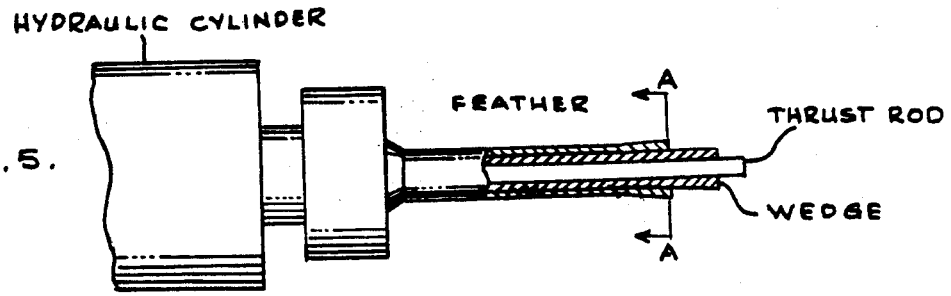
FIG. 5 is a side view of the tool prior to withdrawal of the wedge element.
Figure 6:
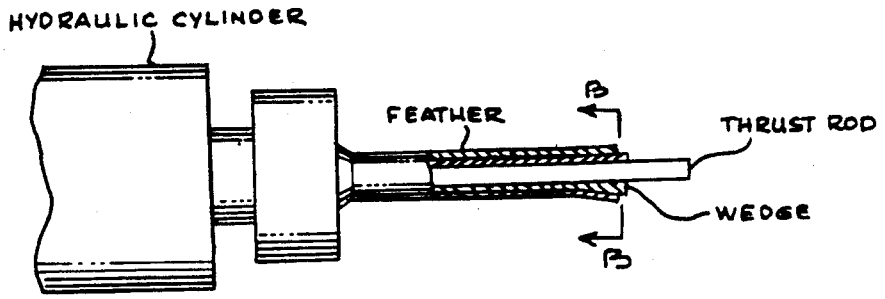
FIG. 6 is a side view of the tool with the wedge in the retracted position.
Figure 7:
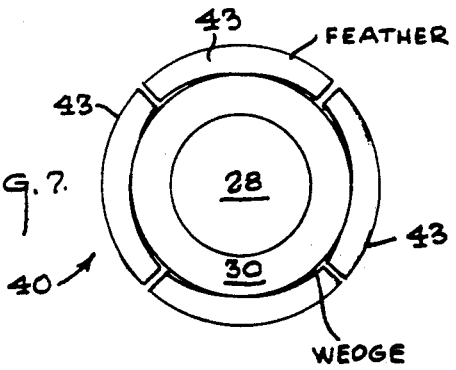
FIG. 7 is an enlarged end view of the feather, wedge and thrust rod as depicted in FIG. 5.

As can be seen by reference to the drawings and in particular to FIG. 4, the rock splitting apparatus that forms the basis of the present invention is designated generally by the reference numeral (10). The apparatus (10) comprises in general: a hydraulic cylinder unit (11); a dual piston unit (12); a thrust rod unit (13); a wedge unit (14); and, a feather unit (15). These units will now be described in seriatim fashion.

As shown in FIG. 4, the hydraulic cylinder unit (11) comprises a stepped shoulder cylinder housing member (16) defining a first enlarged chamber (17) and a second reduced diameter chamber (18) whose purpose and function will be described presently. In addition, the enlarged chamber (17) of the housing member (16) is further provided with a double acting stop element (19) and three fluid ports (20)(21) and (22).

As can also be seen by reference to FIG. 4, the dual piston unit (12) comprises a first piston member (23) having a piston stem element (24) wherein the piston head member (23) is disposed on the left hand side of the enlarged chamber (17). In addition, the second piston head member (25) is disposed on the right hand side of the enlarged chamber (17); and, is further provided with a stem element (26) which extends into the second chamber (18) and central recess (27) which extends through the second piston head member (25) and into the second piston stem element (26); wherein, the first and second piston stem elements (24) and (26) are coaxially aligned within the cylinder housing member (16).

Furthermore, second piston stem member (26) is further provided with an axial bore (26') and the first piston stem member (24) is provided with an inwardly facing axial recess (24'); wherein, the axial recess (24') is threaded to engage the thrust rod unit (13) and the axial bore (26') is dimensioned to slideably receive the thrust rod unit (13). The thrust rod unit (13) of the preferred embodiment comprising a generally cylindrical thrust rod member (28).

Still referring to FIG. 4 it can be appreciated that the plurality of fluid ports (20)(21) and (22) operate in both the supply and return modes with ports (20) and (22) acting as supply ports to drive the first (23) and second (25) piston head members towards one another while fluid port (21) acts as a common return port; wherein, the degree of travel of the both of the piston head members (23)(25) towards one another is limited by the position of the stop element (19) within the enlarged interior chamber (17).

On the other hand, fluid port (21) which is positioned proximate the stop element (19) serves as a supply port when it is desired to drive the first and second piston head members (23) and (25) apart to fully retract the thrust rod member (28) and extend the wedge member (30); while the ports (20) and (22) function as return ports.

Turning now to FIGS. 4, and 7 thru 9, it can be appreciated that the wedge unit (14) of this invention comprises an elongated hollow generally cylindrical wedge member (30) threaded on one end (31) in a suitably threaded recess (29) in the second piston stem member (26) and provided on the other end (32) with an outwardly tapered conical bearing surface (34) whose purpose and function will be described presently.

As can best be seen by reference to FIGS. 3, 4 and 7 thru 9, the feather unit (15) of this invention comprises an elongated hollow generally cylindrical split feather member (40) secured on one end (41) to the exterior of the fluid cylinder housing member (16) and provided on the other end (42) with a plurality of feather segments (43).

Figure 9:
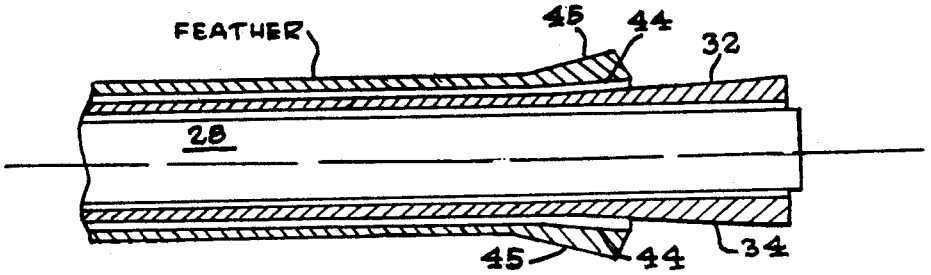

As shown particularly in FIGS. 3 and 9, the internal periphery of each of the feather segments is provided with a conically recessed portion (44) and the external periphery of each segment (43) is provided with an outwardly projecting conical lip portion (45); wherein, the conical angle of the internal periphery of each feather segment (43) coincides with the flared conical bearing surface (34) on the wedge member (30) when the wedge is withdrawn; and, wherein the conical lip portion (45) has a conical profile angle of $\theta$.

As shown in FIG. 2, the external conical profile acts like a stress concentrator focusing the radial load that this element transfers to the rock at the point of the cones maximum diameter. The focusing effect of this design causes the excavation fracture to initiate at a depth in the drill hole under the operator's control. This initiation depth coincides with the feather element's maximum diameter and this action makes it possible to predict the volume of rock that can be excavated by a single application of the tool. This design also makes it possible for a given tool to successfully operate at greater depths and/or in stronger materials than it could otherwise. The angle 8 that describes the cone's inclination is established based on the strength of the rock in which the tool is to be worked. The cone angle $\theta$ is increased proportionally with increases in the strength of the rock to be excavated. Increased cone angles $\theta$ cause greater stress in the rock for a given applied radial load.

Unfortunately this stress focusing effect is not always an optimal condition. One might initially believe that the larger the cone angle $\theta$, the more effective the tool becomes. This is not the case. If the angle $\theta$ becomes too large, then the focused load overcomes the strength of the rock in the immediate area of the feather rock contact zone. This results in the loss of a competent anchor and the tool cannot perform. For this reason, the cone angle must be related to the rock strength. When this invention is used in rock of widely differing strength, then replacement feathers having alternative cone angles $\theta$ are necessary to optimize this tool's performance.

As shown in FIGS. 5 thru 9, the conical bearing surfaces (44) on the feather member's segments (40) also produces improved results relative to the contact area between the feather segments (43) and the wedge (30). The design of this contact surface has a roughly conical shape that eliminates the gap that forms between the wedge and feather elements. The gap in previous designs occurred when the wedge element had been withdrawn into the feather element for the purpose of securing the tool within the drill hole because the feather element had an interior conic bearing surface that matched the wedge before it was withdrawn. Because no gap exists in this invention, the feather failure due to bending stress in the individual feather segments (43) is eliminated.

Figure 8:
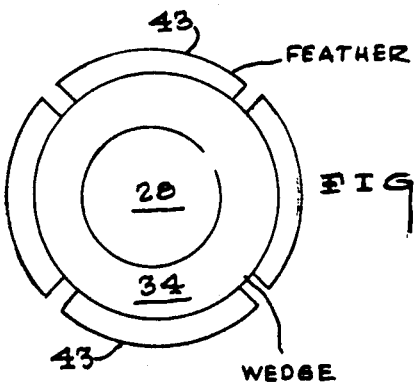
FIG. 8 is an enlarged view of the feather, wedge, and thrust rod as depicted in FIG. 6; and, FIG. 9 is an enlarged cross-sectional view of the feather, wedge, and thrust rod as depicted in FIG. 4.

In the preferred embodiment the working end of the feather member (40) is split so that there are four feather segments (43). In the contact area (44) each of the segments are formed with a conic interior surface. However, the conic surface of each segment is not coaxial with the major axis of the tool nor the other feather segments. Instead for each of the feather segments (43), the axis of its interior conic surface is shifted away from the segment across the tool's major axis for a distance equal to the increase in wedge radius. This shift allows the interior conic surface (44) of the working end of the feather element to match the wedge members conic surface (34), when the wedge is fully withdrawn as shown in FIG. 8.

Another unique aspect of this invention is the provision of the stop element (19) intermediate the first (23) and the second (25) piston head members. This stop element (19) limits the stroke of the second piston (25) to which the wedge member (30) is affixed. The travel of the wedge is thereby restricted so that it cannot be withdrawn past the working end of the feather member. This invention eliminates the feather failure that is a result of the wedge element being withdrawn past the end of the feather element.

The improvements in this invention provide many benefits. First, the mechanical rock breaking elements are rendered more reliable. This results in reduced operating costs and increased production because of less downtime. Second, this invention is more effective. These design changes make it possible for the tool to operate in a wider range of materials and with greater ability to excavate within a given rock type. Finally, this invention provides the operator with greater control over the rock excavation process. The fracture initiation point of the excavation process can be controlled, and thereby the quantity of rock excavated can be accurately predicted for any single application of the tool.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A hydraulically actuated mechanical excavating apparatus adapted to enter a drill hole in a hard compact material, such as rock, and place the adjacent material into a state of axial tension by the combined affect of radial and axial loads to effect the breaking and excavation of material from the surrounding mass; wherein, the apparatus comprises:

a cylinder housing member with a stop element and a plurality of ports;

a first piston head ember disposed on one side of said stop element and a second piston head member disposed on the opposite side of the said stop element;

a thrust rod member operatively secured with said first piston head member and projecting through said cylinder housing member;

a wedge unit comprising an elongated generally hollow cylindrical wedge member operatively secured on one end to said second piston head member and projecting through the cylinder housing member in a surrounding relationship relative to said thrust rod member; and, a feather unit comprising an elongated generally hollow cylindrical feather member secured on one end to the cylinder housing member and being disposed in a surrounding relationship relative to the thrust rod member and the wedge member; wherein, the other end of the feather member is provided with a plurality of feather segments that, in conjunction with the wedge, anchors the apparatus within the drill hole by a radial load when the thrust rod is actuated to contact and load the end of the drill hole, the adjacent material is subjected to an axially directed tensile stress; wherein the other end of the wedge member is provided with an outwardly extending conical bearing surface; and, the inner periphery of the other end of the feather segments are provided with a conical recess which coincides with the conical bearing surface on the wedge member when the wedge has been withdrawn; wherein; each of the feather segments are provided with an outwardly projecting conical lip portion; and, the outwardly projecting conical lip portions on the respective feather segments combine to form a conical profile having the included angle value of 0; wherein, the particular value of 0 will be selected dependent upon the strength of the rock in which the apparatus is employed.

2. The apparatus as in claim 1 wherein the stop element is disposed intermediate said first and said second piston head members to restrict the second piston head travel and thereby the wedge member travel.

3. A hydraulically actuated mechanical excavating apparatus adapted to enter a drill hole in a hard compact material, such as rock, and place the adjacent material into a state of axial tension by combined affect of radial and axial loads to effect the breaking and excavation of material from the surrounding means; wherein, the apparatus comprises:

a cylinder housing member with a stop element and a plurality of ports;

a first piston head member disposed on one side of said stop element and a second piston head member disposed on the opposite side of said stop element;

a thrust rod member operatively secured with said first piston head member and projecting through said cylinder housing member;

a wedge unit comprising an elongated generally hollow cylindrical wedge member operatively secured on one end to said second piston head member and projecting through the cylinder housing member in a surrounding relationship relative to said thrust rod member; and, a feather unit comprising an elongated generally hollow cylindrical feather member secured on one end to the cylinder housing member and being disposed in a surrounding relationship relative to the thrust rod member and the wedge member; wherein, the other end of the feather member is provided with a plurality of feather segments; wherein, the other end of the wedge member is provided with an outwardly extending conical bearing surface; and, the inner periphery of the other end of the feather segments are provided with a conical recess which coincides with the conical bearing surface on the wedge member when the wedge has been withdrawn.

* * * * *